US010216214B2

(12) United States Patent
Park et al.

(10) Patent No.: US 10,216,214 B2
(45) Date of Patent: Feb. 26, 2019

(54) WHEEL BUTTON STRUCTURE

(71) Applicant: Samsung Electronics Co., Ltd., Gyeonggi-do (KR)

(72) Inventors: Young Sun Park, Gyeonggi-do (KR); Geun A Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 243 days.

(21) Appl. No.: 15/079,768

(22) Filed: Mar. 24, 2016

(65) Prior Publication Data

US 2016/0282897 A1 Sep. 29, 2016

(30) Foreign Application Priority Data

Mar. 24, 2015 (KR) ..... 10-2015-0040816

(51) Int. Cl.
*G05G 1/10* (2006.01)
*G05G 5/04* (2006.01)

(52) U.S. Cl.
CPC ..... *G05G 1/10* (2013.01); *G05G 5/04* (2013.01)

(58) Field of Classification Search
CPC ..... G01G 1/10; G01G 1/105; G01G 1/12; G01G 1/087; G01G 1/08; G01G 5/03; G01G 5/04; G01G 5/065; G01G 5/06; B60K 37/06; H01H 3/08; H01H 3/50; H01H 19/001; H01H 19/003; H01H 19/11; H01H 19/14; H01H 19/186; H01H 19/183; H01H 19/18; H04N 1/00397; H03J 1/14; Y10T 74/2084; Y10T 74/20654
USPC .... 74/10.2, 10.29–10.37, 10.1–10.15, 10.22, 74/10.27, 10.41, 10.6, 10.8–10.9
See application file for complete search history.

(56) References Cited

U.S. PATENT DOCUMENTS 504,086 A * 8/1893 Johnson ..... F16H 25/14 74/55
1,608,922 A * 11/1926 Bockius ..... H01G 5/06 361/298.1
2,620,672 A * 12/1952 McMahon ..... H01H 19/24 74/10.41
2,746,573 A * 5/1956 Hastings ..... F16D 59/00 188/69

(Continued)

FOREIGN PATENT DOCUMENTS

EP 1795990 A1 * 6/2007 ..... G05G 1/10
FR 623560 A * 6/1927 ..... H03J 1/14

(Continued)

*Primary Examiner* — Daniel D Yabut
(74) *Attorney, Agent, or Firm* — The Farrell Law Firm, P.C.

(57) ABSTRACT

A wheel button structure is provided. The wheel button structure includes a case part including an upper case through which a guide hole is formed, a wheel part rotating in the case part with respect to a rotation axis fixed to one side of the case part, connected to a transfer device operated while interlocked with the wheel part, and including a barrier wall formed on a surface facing the guide hole to wrap a plurality of times around the rotation axis, and a stopper including a lower portion inserted between a first part of the barrier wall and a second part of the barrier wall adjacent to the first part of the barrier wall and an upper portion inserted into the guide hole, wherein the stopper moves along the guide hole when the wheel part rotates.

15 Claims, 16 Drawing Sheets

(56) References Cited

U.S. PATENT DOCUMENTS

| | | | | | |
|---|---|---|---|---|---|
| 3,059,498 | A * | 10/1962 | Boyd | F42C 19/06 | 74/527 |
| 3,760,640 | A * | 9/1973 | Mayer | H03J 1/14 | 74/10.41 |
| 5,134,898 | A * | 8/1992 | Anderson | G05G 1/08 | 74/527 |
| 5,880,773 | A | 3/1999 | Suzuki | | |
| 7,633,683 | B2 | 12/2009 | Beck et al. | | |
| 7,817,001 | B2 * | 10/2010 | Kramlich | G05G 5/04 | 200/43.11 |
| 8,596,421 | B2 | 12/2013 | Park | | |
| 8,976,523 | B2 | 3/2015 | Song et al. | | |
| 9,372,497 | B2 * | 6/2016 | Wall | G05G 1/08 | |
| 2006/0144185 | A1 * | 7/2006 | Tsai | B25F 5/001 | 74/527 |
| 2008/0239523 | A1 | 10/2008 | Beck et al. | | |
| 2009/0167571 | A1 * | 7/2009 | Loo | H01H 19/001 | 341/35 |
| 2012/0111672 | A1 | 5/2012 | Park | | |
| 2013/0242478 | A1 | 9/2013 | Song et al. | | |
| 2015/0034463 | A1 * | 2/2015 | Breich | G05G 1/08 | 200/17 R |
| 2017/0160765 | A1 * | 6/2017 | Zhao | G05G 5/04 | |

FOREIGN PATENT DOCUMENTS

| | | | | |
|---|---|---|---|---|
| FR | 2584850 | A1 * | 1/1987 | G05G 5/04 |
| GB | 120997 | A * | 12/1918 | B23Q 5/52 |
| JP | 10-203317 | | 4/1998 | |
| JP | 2009-31381 | | 2/2009 | |
| KR | 2002-0049122 | | 6/2002 | |
| KR | 10-0798656 | | 1/2008 | |
| KR | 10-2013-0104648 | | 9/2013 | |
| WO | WO 2011-002259 | | 6/2011 | |

* cited by examiner

<PRIOR ART>

WHEEL BUTTON STRUCTURE

CROSS REFERENCE TO RELATED APPLICATIONS

This application claims priority under 35 U.S.C. § 119(a) to a Korean Patent Application filed on Mar. 24, 2015, in the Korean Intellectual Property Office and assigned Serial No 10-2015-0040816, the entire disclosure of which is incorporated herein by reference.

BACKGROUND

1. Field of Disclosure

The present disclosure relates generally to a wheel button structure in an electronic device.

2. Description of Related Art

Wheel buttons have various functions, and are often used as a device for setting a focus in an electronic device, such as in a camera of the electronic device.

FIG. 1 is a perspective view of a conventional wheel button structure, according to the related art.

Referring to FIG. 1, a coupling relationship between a conventional wheel button 120 in an electronic device and a transfer device 160 is provided. The conventional wheel button 120 includes a stopper provided to a transfer device 160 connected to the wheel button 120, and the wheel button 120 does not have a stopper function.

The wheel button 120 immediately stops in the case where a rotation of the wheel button 120 corresponds to a maximum or minimum value of a focal length and a user is required to recognize that the wheel button 120 is not rotated anymore. However, since the transfer device 160 is connected to the wheel button 120 through a shaft 162 and a gear 161, the user does not immediately recognize that the wheel button 120 is not rotated.

In addition, the user does not feel the rotation of the wheel button 120 even though the wheel button 120 is rotated.

SUMMARY

The present disclosure has been made to address at least the problems and/or disadvantages described above, and to provide at least the advantages described below.

Accordingly, an aspect of the present disclosure is to provide a wheel button structure in which a wheel button has a stopper function to allow the user to instantly recognize that the wheel part stops.

Accordingly, another aspect of the present disclosure is to provide a wheel button structure having a serration structure to allow a user to recognize a rotation of the wheel button while the wheel button is rotated.

In accordance with an aspect of the present disclosure, a wheel button structure is provided. The wheel button structure includes a case part including an upper case through which a guide hole is formed, a wheel part rotating in the case part with respect to a rotation axis fixed to one side of the case part, connected to a transfer device operated while interlocked with the wheel part, and including a barrier wall formed on a surface facing the guide hole to wrap a plurality of times around the rotation axis, and a stopper including a lower portion inserted between a first part of the barrier wall and a second part of the barrier wall adjacent to the first part of the barrier wall and an upper portion inserted into the guide hole, wherein the stopper moves along the guide hole when the wheel part rotates.

BRIEF DESCRIPTION OF THE DRAWINGS

The above and other aspects, features, and advantages of the present disclosure will be more apparent from the following description taken in conjunction with the accompanying drawings, in which.

DETAILED DESCRIPTION OF EMBODIMENTS OF THE PRESENT DISCLOSURE

Figure 1:
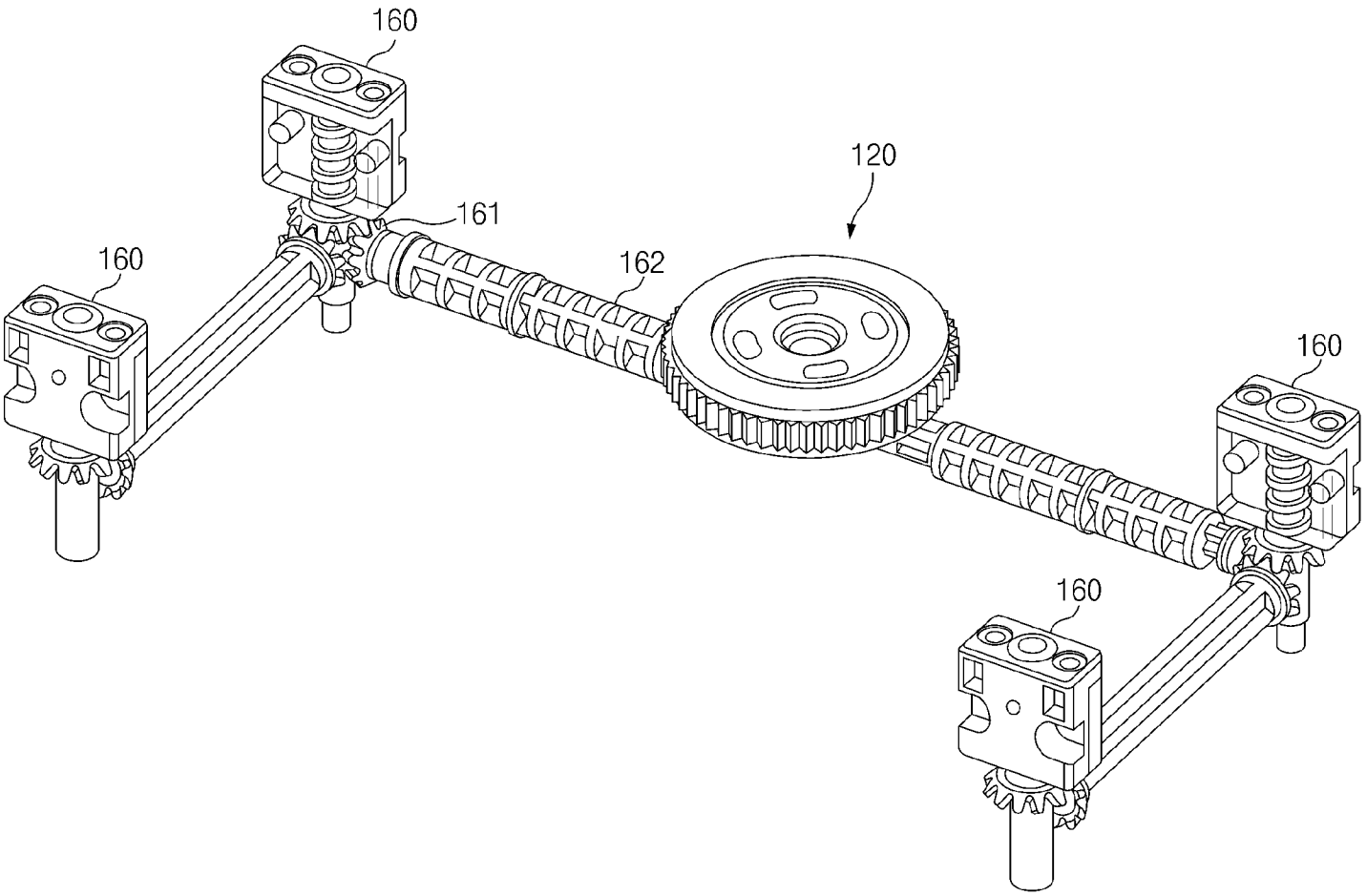
FIG. 1 is a perspective view of a conventional wheel button structure, according to an embodiment of the related art.

Various embodiments of the present disclosure may be described with reference to accompanying drawings. Accordingly, those of ordinary skill in the art will recognize that modification, equivalent, and/or alternative on the various embodiments described herein can be made without departing from the scope and spirit of the present disclosure. With regard to description of drawings, similar components may be marked by similar reference numerals.

The expressions "have", "may have", "include" and "comprise" used herein indicate existence of corresponding features (e.g., elements such as numeric values, functions, operations, or components) but do not exclude the presence of additional features.

The expressions "A or B", "at least one of A or/and B", and "one or more of A or/and B", and the like used herein may include any and all combinations of one or more of the associated listed items. For example, the term "A or B", "at least one of A and B", and "at least one of A or B" may refer to all of the case (1) where A is included, the case (2) where B is included, or the case (3) where both A and B are included.

The terms, "first", "second", and the like used herein may refer to various elements of various embodiments of the present disclosure, but do not limit the elements. For example, such terms do not limit the order and/or priority of the elements. Furthermore, such terms may be used to distinguish one element from another element. For example, "a first user device" and "a second user device" indicate different user devices. For example, without departing from the scope of the present disclosure, a first element may be referred to as a second element, and similarly, a second element may be referred to as a first element.

It will be understood that when an element (e.g., a first element) is referred to as being (operatively or communicatively) "coupled with/to" or "connected to" another element (e.g., a second element), it can be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used herein may be used interchangeably with, for example, the expression "suitable for", "having the capacity to", "designed to", "adapted to", "made to", or "capable of". The term "configured to" does not mean only "specifically designed to" in hardware. Instead, the expression "a device configured to" may mean that the device is "capable of" operating together with another device or other components. For example, a "processor configured to perform A, B, and C" may mean a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in this specification are used to describe specific embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal manner unless expressly so defined herein. In some cases, even if terms are defined in the specification, they are not to be interpreted to exclude embodiments of the present disclosure.

An electronic device according to various embodiments of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, wearable devices (e.g., smart glasses, head-mounted-devices (HMDs), electronic apparels, electronic bracelets, electronic necklaces, electronic appcessories, electronic tattoos, smart mirrors, or smart watches, and the like.

The electronic devices may be smart home appliances. The smart home appliances may include at least one of, televisions (TVs), digital versatile disc (DVD) players, audio devices, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ and PlayStation™), electronic dictionaries, electronic keys, camcorders, electronic picture frames, etc.

The electronic devices may include at least one of medical devices (e.g., various portable medical measurement devices (e.g., a blood glucose monitoring device, a heartbeat measuring device, a blood pressure measuring device, a body temperature measuring device, and the like)), a magnetic resonance angiography (MRA) machine, a magnetic resonance imaging (MRI) machine, a computed tomography (CT) machine, scanners, and ultrasonic devices, navigation devices, global navigation satellite systems (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller machines (ATMs), points of sale (POSs) machines, or Internet of Things (IoT) devices (e.g., light bulbs, various sensors, electric or gas meters, sprinkler devices, fire alarms, thermostats, street lamps, toasters, exercise equipment, hot water tanks, heaters, boilers, etc.).

The electronic devices may include at least one of furniture or buildings/structures, electronic boards, electronic signature receiving devices, projectors, or various measuring instruments (e.g., water meters, electricity meters, gas meters, or wave meters, etc.).

The electronic devices, according to an embodiment of the present disclosure, may be one or more combinations of the above-mentioned devices. An electronic device may be a flexible electronic device.

Also, electronic devices, according to various embodiments of the present disclosure, are not limited to the above-mentioned devices, and may include new electronic devices according to development of new technologies.

Hereinafter, an electronic device, according to various embodiments of the present disclosure, will be described in detail with reference to accompanying drawings. As used herein, the term "user" may refer to a person who utilizes the electronic device or a machine (e.g., an artificial intelligence electronic device) that utilizes the electronic device.

Figure 2:
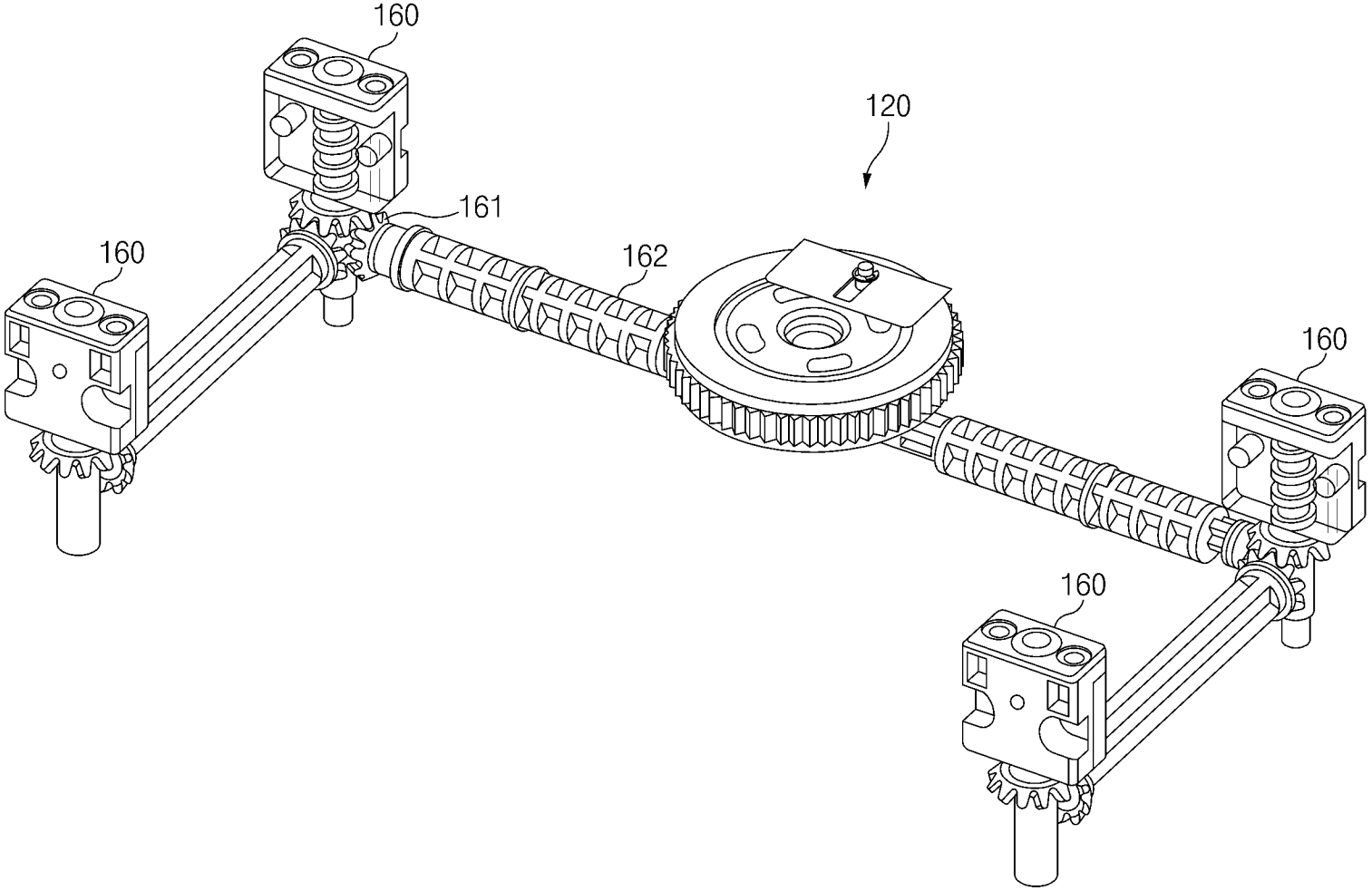
FIG. 2 is a perspective view showing a wheel button structure connected to a transfer device, according to an embodiment of the present disclosure.
Figure 3:
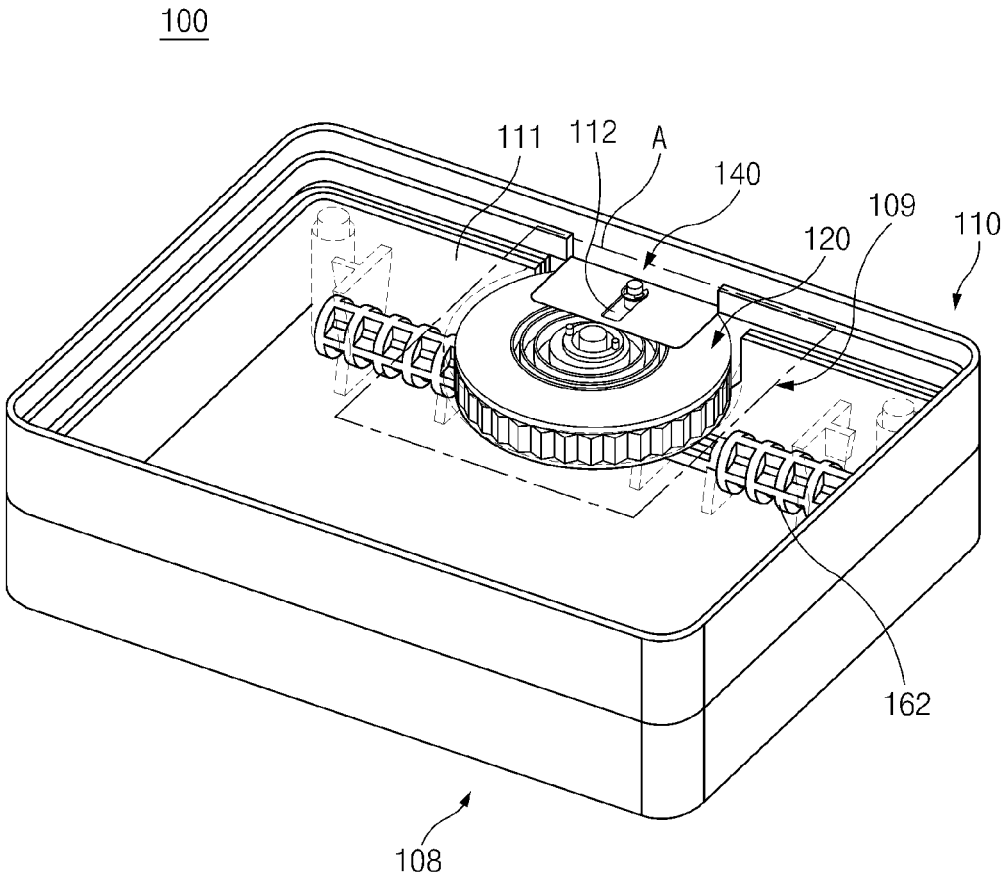
FIGS. 3-6 are views of a wheel button structure, according to an embodiment of the present disclosure.
Figure 4:
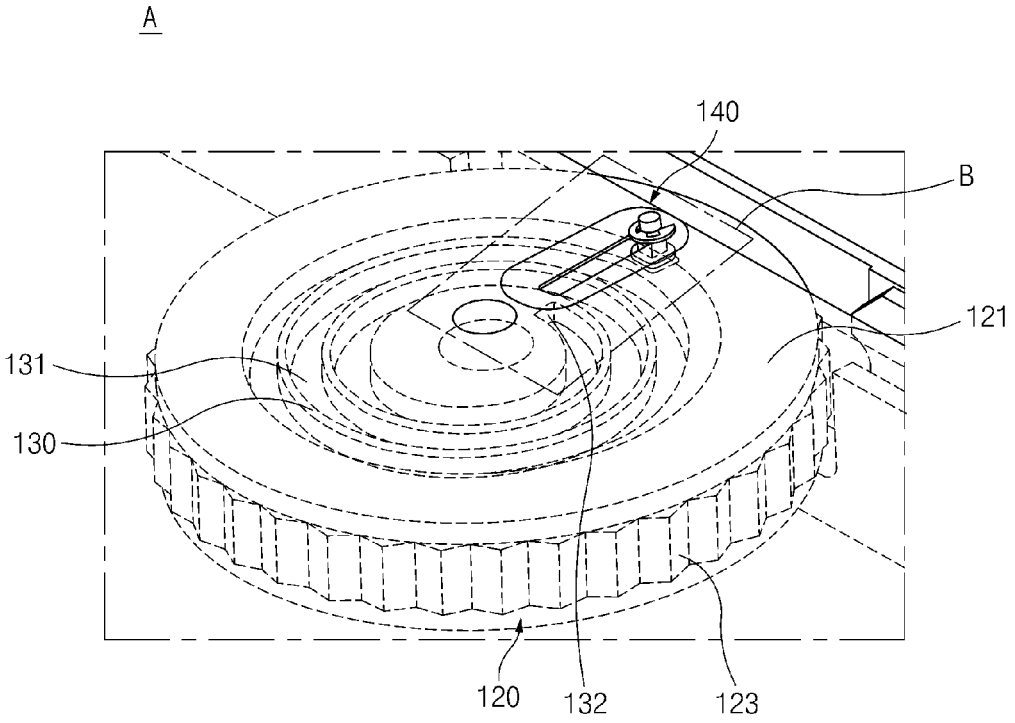
Figure 5:
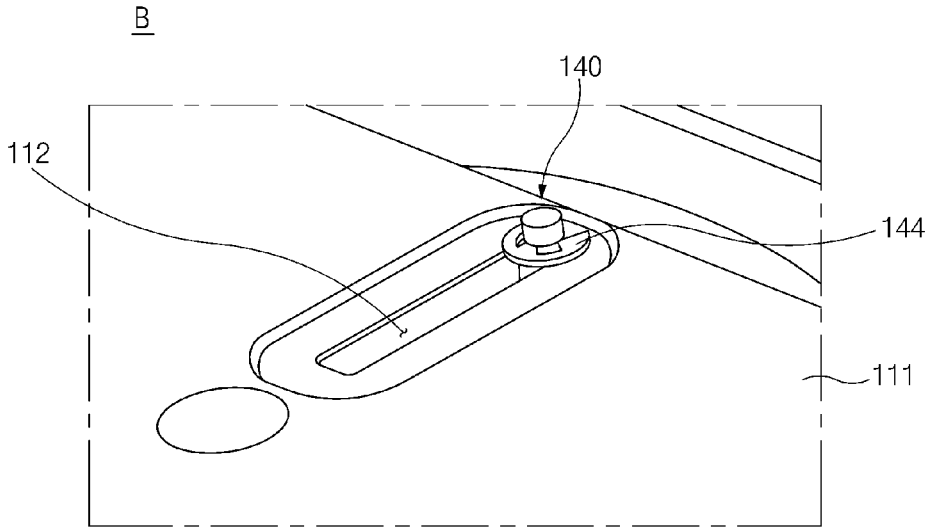

FIG. 2 is a perspective view showing a wheel button structure connected to a transfer device, according to an embodiment of the present disclosure;

FIGS. 3-5 are views of a wheel button structure, according to an embodiment of the present disclosure.

Figure 6:
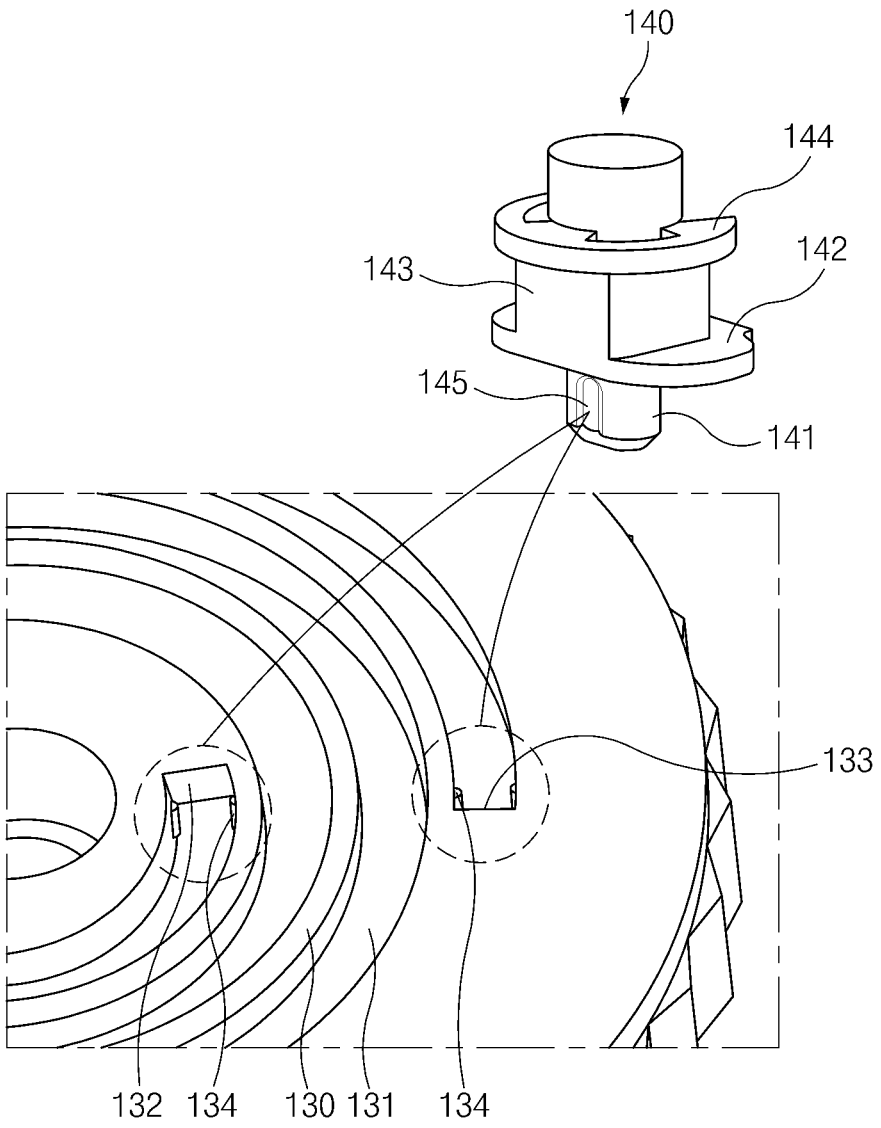
Figure 7A:
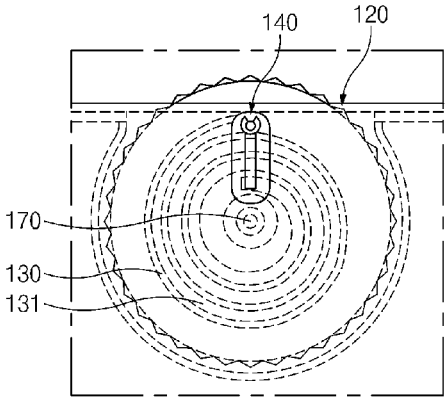
FIGS. 7A-7D are views of an operation state of a wheel button structure, according to an embodiment of the present disclosure.
Figure 7B:
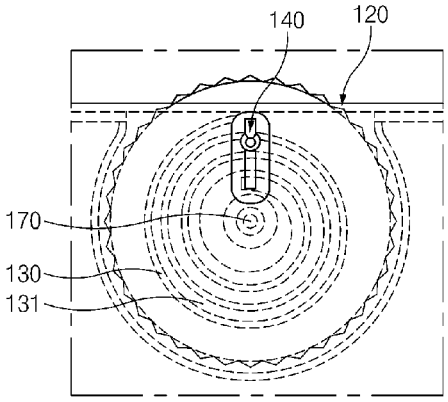
Figure 7C:
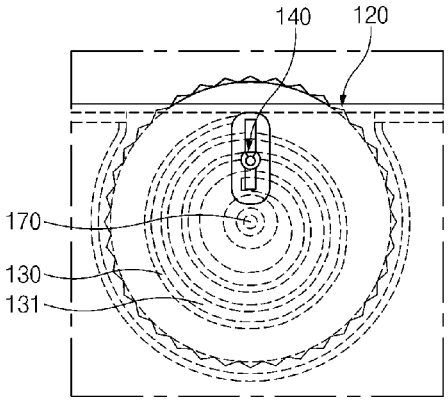
Figure 7D:
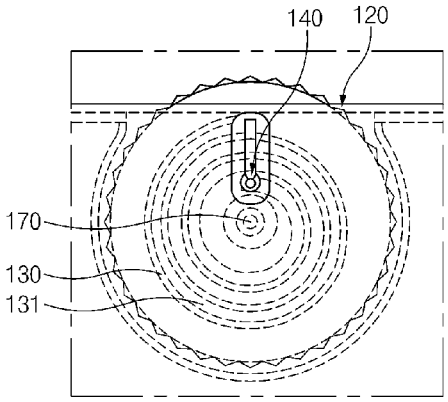

Referring to FIGS. 3-5, a wheel button structure 100 is provided. FIG. 3 illustrates an enlarged view of portion "A" of FIG. 3. FIG. 5 illustrates an enlarged view of portion "B" of FIG. 4. FIG. 6 illustrates a coupling relation between a stopper 140 and a barrier wall 130 of the wheel structure.

Referring to FIGS. 2-5, the wheel button structure 100 includes a case part 110, a wheel part 120, and the stopper 140. The case part 110 includes an upper case 111 through which a guide hole 112 is formed. The wheel part 120 rotates in the case part 110 with respect to a rotation axis 170 fixed to one side of the case part 110, connected to a transfer device 160 operated while interlocked with the wheel part 120. The wheel part 120 includes the barrier wall 130 formed on a surface facing the guide hole 112 to wrap several times the rotation axis 170 (as shown in FIGS. 7A-7D). The stopper 140 includes a lower portion inserted between the barrier wall 130 and a barrier wall adjacent to the barrier wall 130, and an upper portion inserted into the guide hole 112 such that the stopper 140 moves along the guide hole 112 when the wheel part 120 is rotated.

Figure 10:
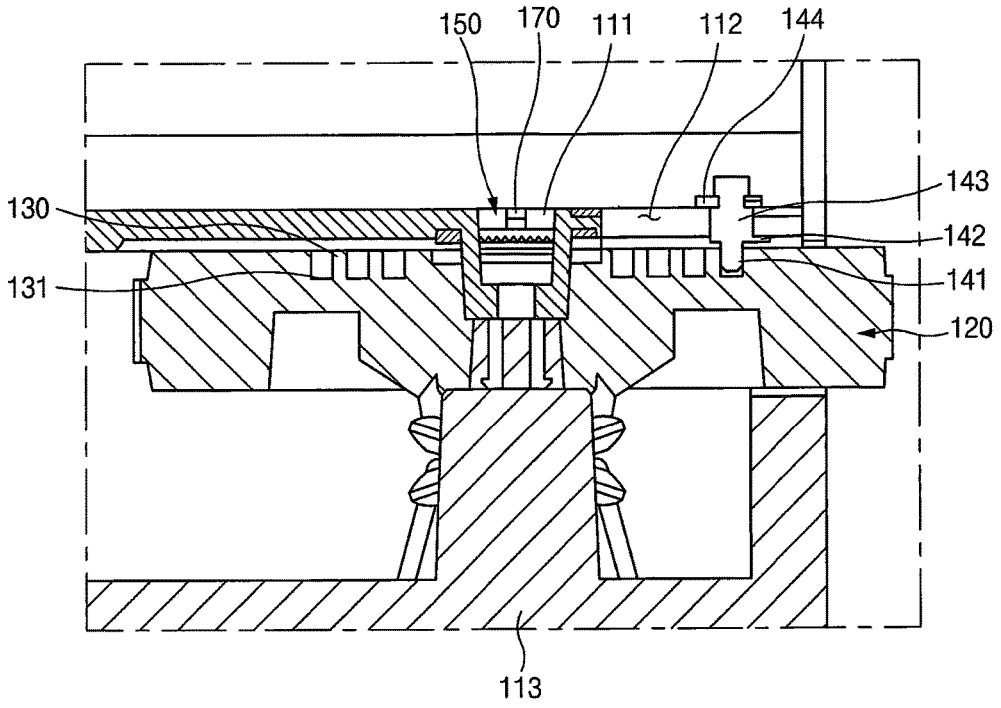
FIG. 10 is a cross-sectional view of a wheel button structure, according to an embodiment of the present disclosure.

The case part 110 includes a front case 109 through which a hole is formed to allow one side of the wheel part 120 to be exposed to the outside, a lower case 108 disposed under the upper case 111, and a rotation axis fixing case 113 (as shown in FIG. 10) disposed between the upper case 111 and the lower case. The rotation axis 170 is coupled and fixed to the rotation axis fixing case 113.

The wheel part 120 has a wheel shape in which a cross section thereof has a substantially circular shape and is rotated with respect to the rotation axis 170 fixed to the rotation axis fixing case 113. A portion of a body of the wheel part 120 is exposed to the outside through the hole formed through the front case, and thus the user may touch a side surface 123 of the exposed body such that the wheel part 120 is rotated with respect to the rotation axis 170. The wheel part 120 may have a variety of shapes in the cross-section other than the circular shape as long as the wheel part 120 is rotated with respect to the rotation axis 170.

Referring to FIGS. 4 to 6, the barrier wall 130 is formed on an upper surface 121 of the wheel part 120, which faces the upper case 111. The barrier wall 130 may wrap several times around a center of the wheel part 120, i.e., the rotation axis 170. The barrier wall 130 may have a spiral shape wrapping several times around the rotation axis 170, as shown in FIG. 4.

That is, one end 132 of the barrier wall 130 is disposed at a position adjacent to the rotation axis 170 and the other end 133 of the barrier wall 130 is disposed at a position more spaced apart from the rotation axis 170 than the one end 132 in a diameter direction. Accordingly, the barrier wall 130 has an opened curve after wrapping several times around the rotation axis 170 rather than a closed curve.

The barrier wall 130 wraps several times around the rotation axis 170 and a distance between the each barrier wall 130 is set to a predetermined distance. That is, each barrier wall 130 is spaced apart from the other at regular intervals.

The barrier wall 130 protrudes from the upper surface 121 of the wheel part 120 and a bottom surface 131 between the barrier wall 130 is disposed at a position lower than the upper surface 121 of the wheel part 120, and thus the barrier wall 130 protrudes higher than the bottom surface 131.

The stopper 140 moves along the guide hole 112, and substantially simultaneously, the one end 132 of the barrier wall 130 is disposed at a position corresponding to one end of the guide hole 112 and the other end 133 of the barrier wall 130 is disposed at a position corresponding to the other end of the guide hole 112 while the stopper 140 moves between the barrier walls 130.

Referring to FIG. 6, the stopper 140 includes a first body 141, a second body 143, a first separation preventing plate 142, and a second separation preventing plate 144. The first body 141 is inserted between the barrier wall 130 and moves along the barrier wall 140. The second body 143 is inserted into the guide hole 112 and moves along the guide hole 112. The first separation preventing plate 142 is disposed between the first and second bodies 141 and 143 to prevent the first and second bodies 141 and 143 from being separated. The second separation preventing plate 144 is disposed on the upper case 111 and is coupled to the second body 143.

The first body 141 should not be limited to the above-mentioned embodiments as long as the first body 141 may be inserted into between the barrier wall 130 and move between the barrier wall 130. Also, the second body 143 should not be limited to the above-mentioned embodiments as long as the second body 143 may be inserted into the guide hole 112 and move along the guide hole 112.

The first separation preventing plate 142 is disposed between the first body 141 and the second body 143 and has a width greater than a width of the guide hole 112. A lower surface of the first separation preventing plate 142 makes contact with the upper surface of the barrier wall 130. In this case, the first body 141 is formed to have a length such that the lower surface does not make contact with the bottom surface 131 between the barrier wall 130 (as shown in FIG.10).

Accordingly, the bottom surface 131 of the first separation preventing plate 142 is disposed on the upper surface of the barrier wall 130 and the first body 141 is formed to have the length such that the lower surface does not make contact with the bottom surface 131 between the barrier wall 130. Therefore, the bottom surface 131 of the first body 141 does not make contact with the bottom surface 131 between the barrier wall 130 while moving the barrier wall 130, and thus a friction between the first body 141 and the barrier wall 140 may be reduced.

In addition, the first separation preventing plate 142 may have the width greater than that of the guide hole 112 and the stopper 140 may not be separated from the guide hole 112.

The stopper 140 further includes the second separation preventing plate 144 making contact with the upper surface of the upper case 111 and coupled to the second body 143.

FIGS. 7A-7D are views of an operation state of a wheel button structure, according to an embodiment of the present disclosure.

Figure 8:
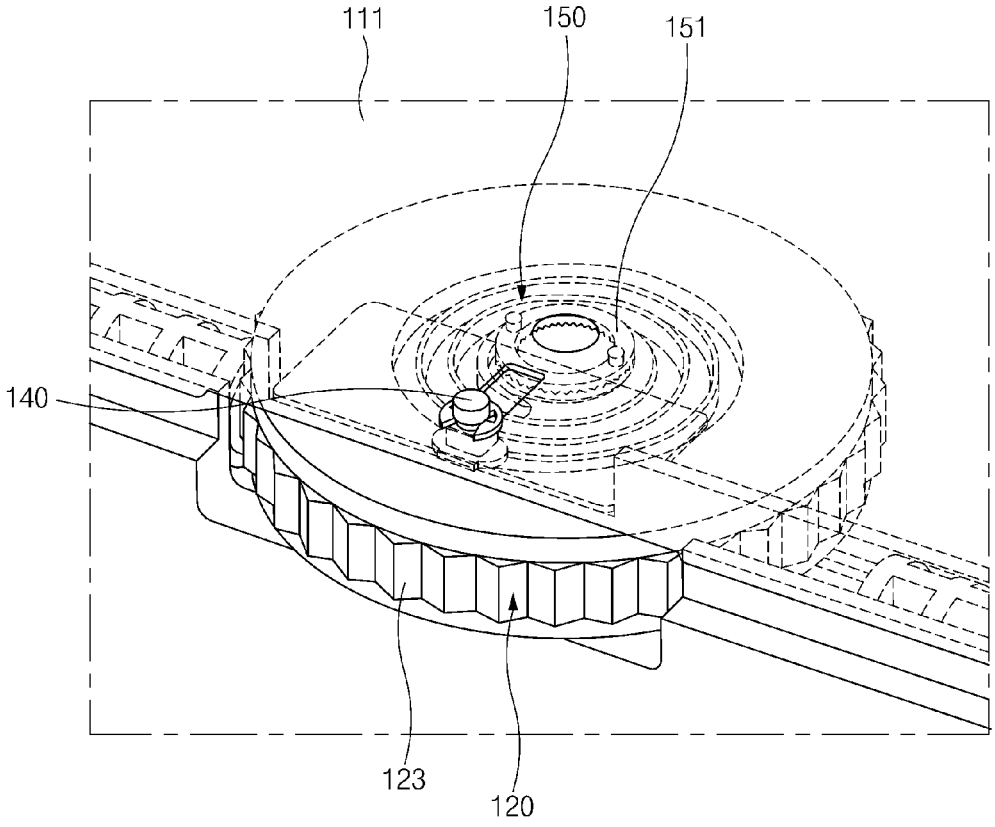
FIG. 8 is a perspective view of a wheel button structure, according to an embodiment of the present disclosure.

FIG. 8 is a perspective view of a wheel button structure, according to an embodiment of the present disclosure.

Referring to FIGS. 7A-7D and FIG. 8, when the stopper 140 is in an initial state, i.e., a state in which the stopper 140 is disposed at the other end of the barrier wall 130 and substantially simultaneously disposed at the other end of the guide hole 122, the stopper 140 moves along the barrier wall 130 during the rotation of the wheel part 120, but the movement of the stopper 140 may be restricted by the guide hole 112. Therefore, the stopper 140 moves linearly when approaching the center of the wheel part 120.

FIGS. 7A-7D show positions of the stopper 140 in the case where the wheel part 120 rotates at one to four times. Due to the rotation of the wheel part 120, the stopper 140 moves between the barrier wall 130 and linearly moves along the guide hole 112 to approach the center of the wheel part 120. The stopper 140 may stop at the one end of the barrier wall 130 when the wheel part 120 rotates at a maximum angle. In this case, a protrusion 134 (as shown in FIG. 6) formed at the one end of the barrier 130 may be inserted into a recess 145 of the stopper 140, and thus the user may recognize that the stopper 140 moves to the one end of the wheel part 120. In addition, the stopper 140 is securely engaged with the wheel part 120.

In the case where the wheel part 120 rotates in an opposite direction, the stopper 140 moves between the barrier wall 130 of the wheel part 120, and substantially simultaneously, moves linearly along the guide hole 122 as the above-mentioned principle, and thus the stopper 140 moves farther away from the center of the wheel part 120. In addition, the stopper 140 may stop at the other end of the barrier wall 130 in the case where the wheel part 120 rotates in the opposite direction at the maximum angle.

A lower portion of the stopper 140 is inserted into the barrier wall 130 of the wheel part 120 that rotates with respect to the rotation axis 170 and an upper portion of the stopper 140 is inserted into the guide hole 112 formed through the case part 110 that is held without moving. Thus, the stopper 140 moves linearly when the wheel part 120 rotates and may stop at the one end 132 or the other end 133 of the barrier wall 130 formed in the wheel part 120.

Accordingly, the wheel button structure 100 realizes the stop function by using the wheel part 120 and the stopper 140, which is separated from the transfer device 160 connected to the wheel part 120.

The wheel button structure 100 restricts the maximum rotation range of the wheel part 120 by using the number of the wraps of the barrier wall 130 with respect to the rotation axis 170.

Referring to FIG. 8, in the case where the barrier wall 130 wraps three times the rotation axis 170, the wheel part 120 stops after rotating with respect to the rotation axis 170 three times. Although not shown in figures, in the case where the barrier wall 130 wraps two times the rotation axis 170, the wheel part 120 stops after rotating with respect to the rotation axis 170 two times.

The wheel button structure 100 further includes a serration part 150 to sense the rotation of the wheel part 120 in the case where the user rotates the wheel part 120.

The serration part 150 has a structure in which a protrusion makes contact with a surface having a sawtooth shape in a cross-section and the user may sense the rotation of the wheel part 120 in accordance with the rotation of the surface having the sawtooth shape or the protrusion.

Figure 9:
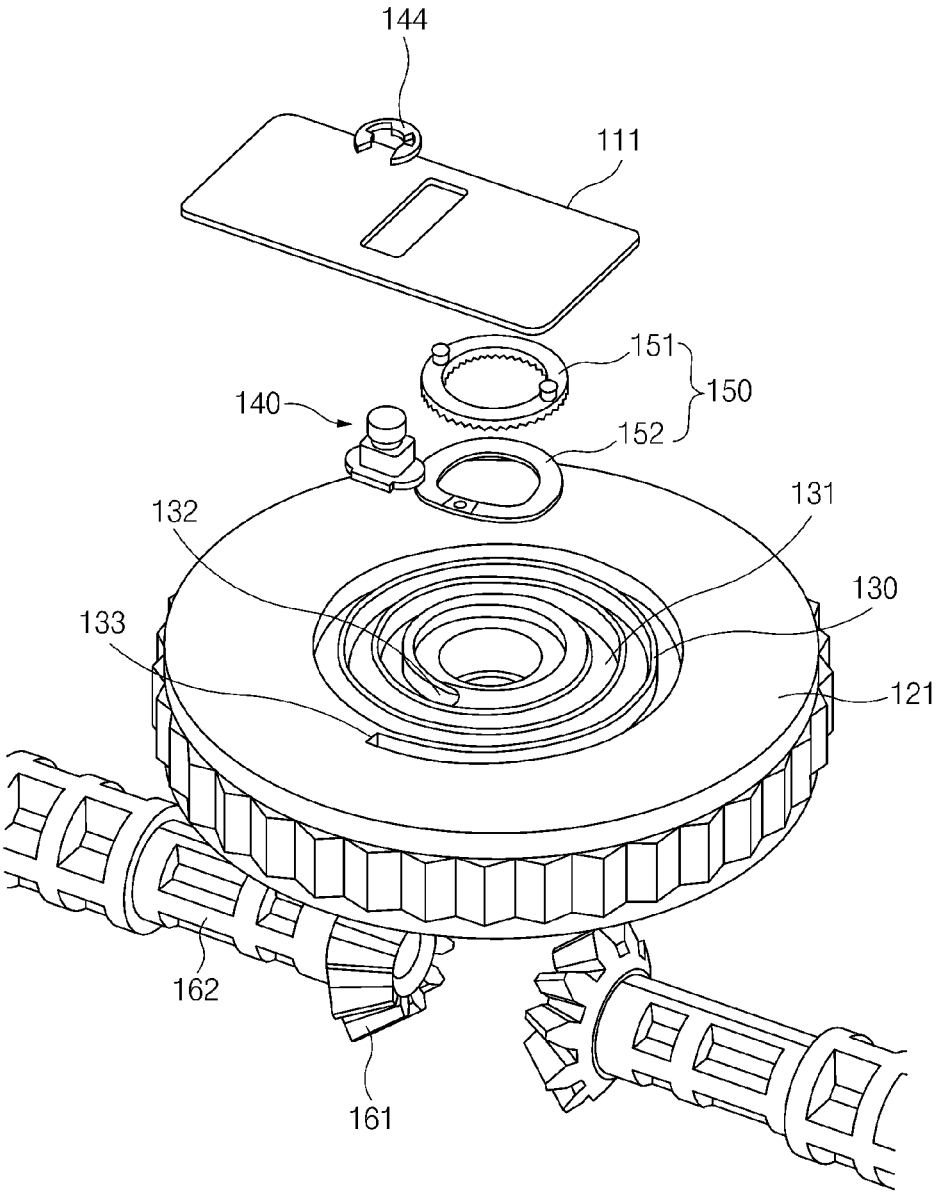
FIG. 9 is an exploded perspective view of a wheel button structure, according to an embodiment of the present disclosure.
Figure 11:
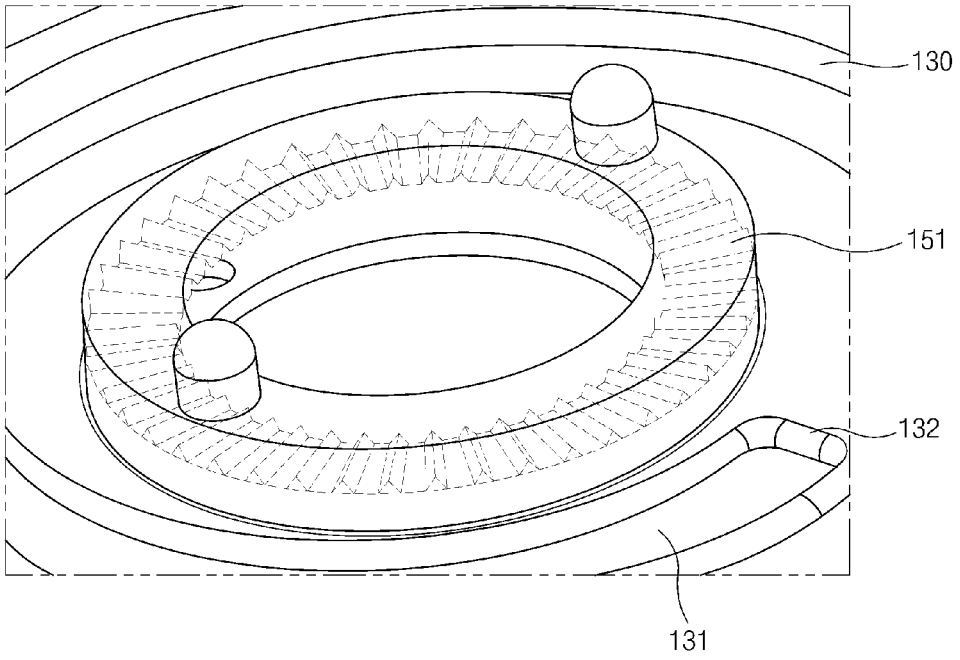
FIGS. 11 and 12 are enlarged perspective views of a serration part, according to an embodiment of the present disclosure.
Figure 12:
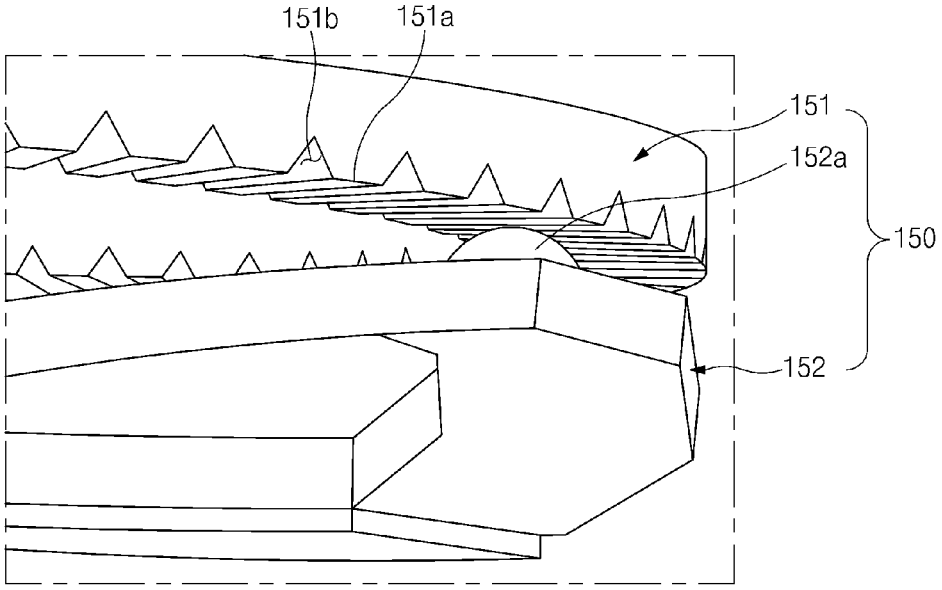

FIG. 9 is an exploded perspective view of a wheel button structure, according to an embodiment of the present disclosure. FIG. 10 is a cross-sectional view of a wheel button structure, according to an embodiment of the present disclosure. FIGS. 11 and 12 are an enlarged perspective views of a serration part, according to an embodiment of the present disclosure.

Referring to FIGS. 9 to 12, according to an embodiment, the serration part 150 includes a serration plate 151 and a first spring part 152. The serration plate 151 includes a plurality of first protrusions 151*a* formed on a lower surface of the serration plate 151. The first spring part 152 includes a second protrusion 152*a* protruded toward the first protrusions 151*a* and sequentially making contact with the first protrusions 151*a* when the wheel part 120 rotates.

The serration plate 151 is fixed to the upper case 111 and the first spring part 152 is fixed to the wheel part 120. The second protrusion 152*a* rotates in accordance with the rotation of the wheel part 120, and thus the second protrusion 152*a* sequentially makes contact with the first protrusions 151*a*.

Referring to FIGS. 9 and 11-12, the serration plate 151 has a substantially ring shape that is the same as that of the rotation axis 170, and the first protrusions 151*a* are successively formed on the lower surface of the serration plate 151. Each first protrusion 151*a* corresponds to a portion of a polygonal shape or a curved surface in a cross-section.

FIG. 12 shows the first protrusions 151*a* each having a substantially trapezoid shape in a cross-section, however, the shape of each first protrusion 151*a* should not be limited to the trapezoid shape. That is, the first protrusions 151*a* includes a shape defined by a recess 151*b* recessed in one direction between the first protrusions 151*a*, which corresponds to a void, allowing the first protrusions 151*a* to be spaced apart from each other, and having a substantially quadrangular shape, a substantially triangular shape, or a substantially circular shape.

The serration plate 151 is fixed to the lower surface of the upper case 111.

Referring to FIG. 12, the first spring part 152 includes the second protrusion 152*a* protruded toward the first protrusions 151*a* to make contact with the first protrusions 151*a*. The first spring part 152 has a substantially ring shape corresponding to that of the serration plate 151, and the second protrusion 152*a* protruded toward the first protrusions 151*a* is disposed on the upper surface. In FIG. 12, one second protrusion 152*a* is disposed on the first spring part 152, but the number of the second protrusion 152*a* should not be limited to one. That is, the second protrusion 152*a* may be provided in a plural number on the first spring part 152.

Referring to FIGS.10 to 12, the first spring part 152 is fixed to the upper surface 121 of the wheel part 120. For instance, the first spring part 152 has the ring shape as described above and the center of the first spring part 152 is disposed at the same position as the rotation axis 170. Therefore, since the first spring part 152 is disposed on the upper surface 121 of the wheel part 120 that rotates with respect to the rotation axis 170, the first spring part 152 rotates in association with the rotation of the wheel part 120.

Thus, the first spring part 152 rotates when the user rotates the wheel part 120, so that the second protrusion 152*a* making contact with the first protrusions 151*a* formed on the first spring part 152 rotates. In addition, since the recess 151*b* is formed between the first protrusions 151*a*, the second protrusion 152*a* sequentially makes contact with the first protrusion 151*a*, the recess 151*b*, and the first protrusion 151*a* during the rotation of the wheel part 120.

That is, the second protrusion 152*a* makes contact with an uneven surface formed by the first protrusions 151*a* and the recess 151*b*, and thus the user may recognize whether the wheel part 120 rotates. In this case, the first spring part 152 senses the rotation of the wheel part 120 since the second protrusion 152*a* makes contact with the first protrusions 151*a* while pressurizing the first protrusions 151*a* and may sequentially make contact with the first protrusions 151*a* and the recess 151*b* during the rotation of the wheel part 120.

Figure 13:
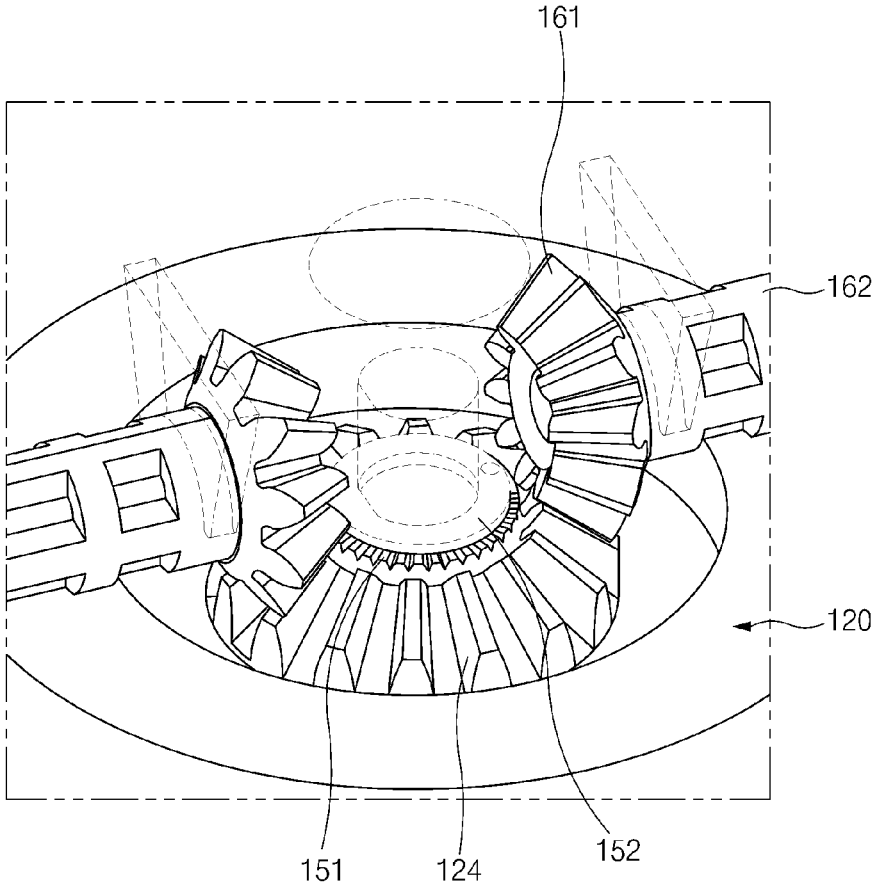
FIG. 13 is a perspective view of a rear portion of a wheel button structure, according to an embodiment of the present disclosure.
Figure 14:
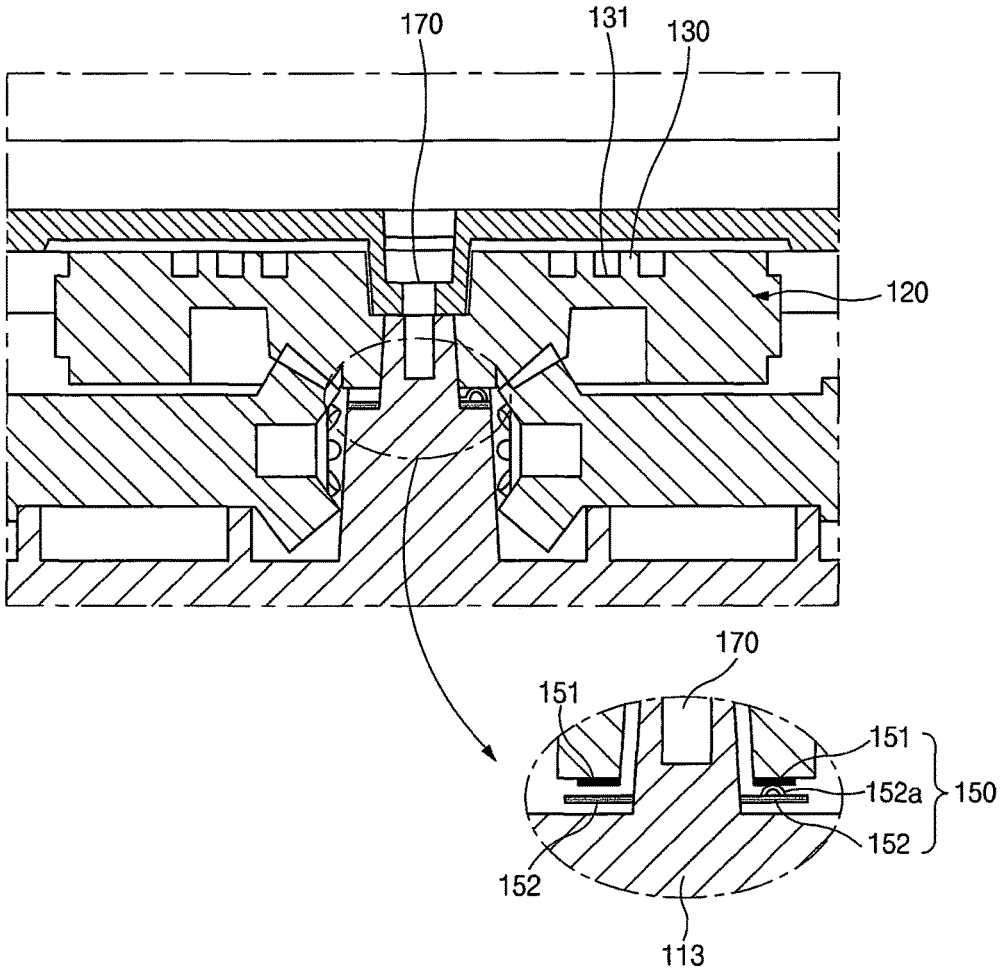
FIG. 14 is a cross-sectional view of a wheel button structure, according to an embodiment of the present disclosure.

FIG. 13 is a perspective view of a rear portion of a wheel button structure, according to an embodiment of the present disclosure. FIG. 14 is a cross-sectional view of a wheel button structure, according to an embodiment of the present disclosure.

Referring to FIGS. 13 and 14, a serration part 150, according to another embodiment different from that described with respect to FIGS. 9-12, includes a serration plate 151 and a first spring part 152. The serration plate 151 includes a plurality of first protrusions 151*a* formed on a lower surface of the serration plate 151. The first spring part 152 includes a second protrusion 152*a* protruded toward the first protrusions 151*a* and sequentially making contact with the first protrusions 151*a* when the wheel part 120 rotates.

The first spring part 152 is fixed to one side of the case part 110 and the serration plate 151 is fixed to the wheel part 120. The first protrusions 151*a* rotates in accordance with the rotation of the wheel part 120, and thus the second protrusion 152*a* sequentially makes contact with the first protrusions 151*a*.

That is, the first spring part 152 rotates in the embodiment described with respect to FIGS. 9-12, but the serration plate 151 rotates in the embodiment described with respect to FIGS. 13-14.

Referring to FIGS. 13 and 14, the serration plate 151 is integrally formed with the wheel part 120 as a single body in the center of the lower surface of the wheel part 120, and thus the serration plate 151 rotates when the wheel part 120 rotates. The serration plate 151 has a substantially ring shape, such as that described with respect to FIGS. 9-12, and a center of the serration plate 151 matches with the rotation axis 170, so that the serration plate 151 rotates in the case where the wheel part 120 rotates.

In this case, different from the structure in which the serration plate 151 is integrally formed with the wheel part 120 in a single body, the serration plate 151 is attached to and fixed to the lower surface of the wheel part 120 after being separately manufactured.

The first protrusions 151*a* may be successively formed on the lower surface of the serration plate 151. Each of the first protrusions 151*a* may be a portion of a polygonal shape or a curved surface in a cross-section.

The first spring part 152 is fixed to the case part 110. The first spring part 152 has a shape corresponding to the serration plate 151, is disposed under the serration plate 151, and includes the second protrusion 152*a* making contact with the first protrusions 151*a* formed on the serration plate 151.

Since the serration plate 151 is formed at the center of the wheel part 120 and the wheel part 120 rotates with respect to the rotation axis 170, the first spring part 152 is fixed to one side of the case part 110, i.e. the rotation axis fixing case 113 inserted into and fixed to the rotation axis 170. In the case where the first spring part 152 has the ring shape corresponding to the serration plate 151, the first spring part 152 surrounds the rotation axis fixing case 113 and is fixed to the rotation axis 170 fixing case 113.

The second protrusion 152*a* disposed on the first spring part 152 is disposed under the first protrusions 151*a* and sequentially makes contact with the first protrusion 151*a*, the recess 151*b*, the first protrusion 151*a*, and the recess 151*b* during the rotation of the wheel part 120.

That is, the second protrusion 152*a* makes contact with the uneven surface defined by the first protrusions 151*a* and the recess 151*b* under the lower surface of the serration plate 151, and thus the user may recognize whether the wheel part 120 rotates. In this case, the first spring part 152 senses the rotation of the wheel part 120 since the second protrusion 152*a* makes contact with the first protrusions 151*a* while pressurizing the first protrusions 151*a* and sequentially makes contact with the first protrusions 151*a* and the recess 151*b* during the rotation of the wheel part 120.

Figure 15:
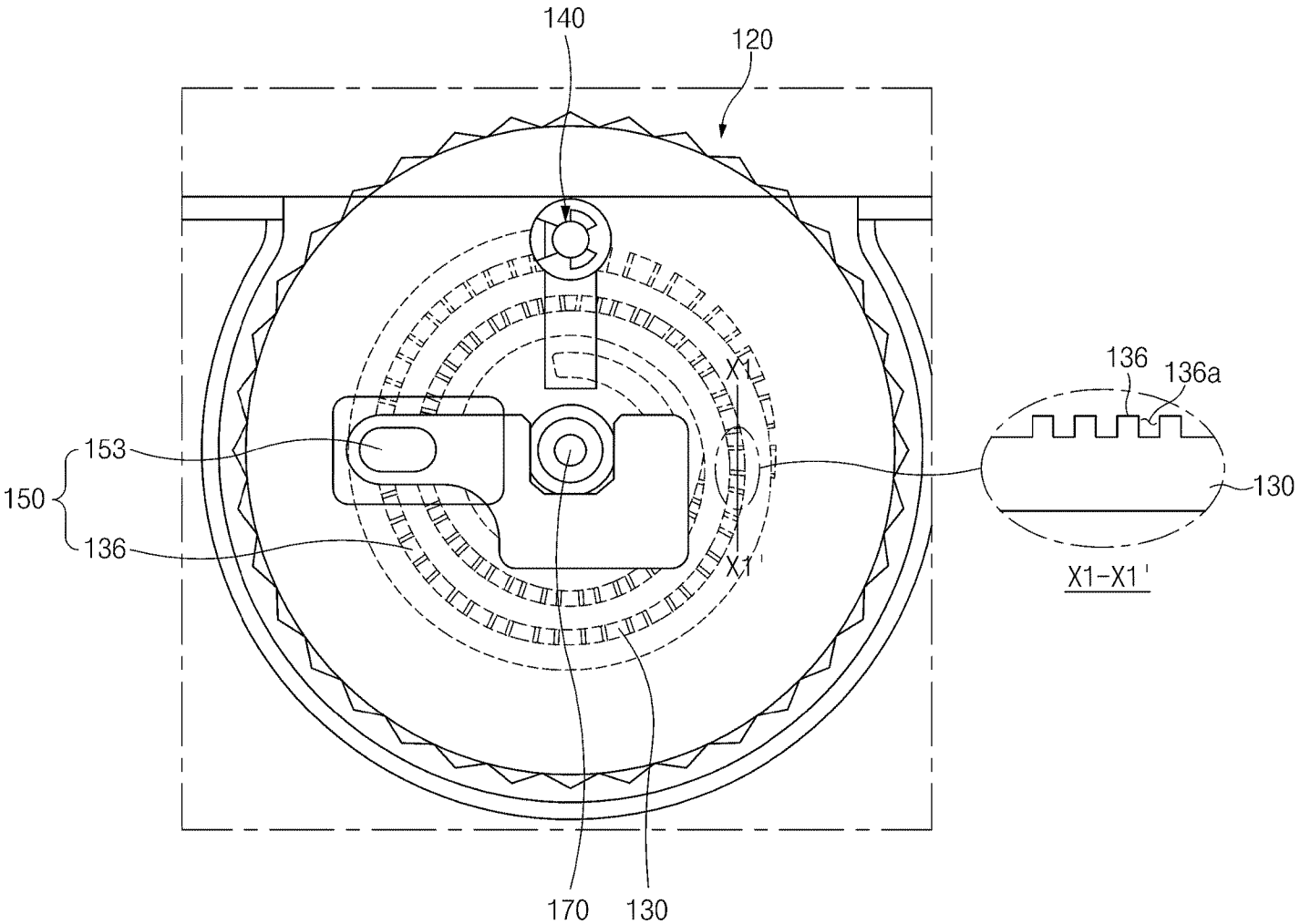
FIG. 15 is a plan view of a wheel button structure, according to an embodiment of the present disclosure.
Figure 16:
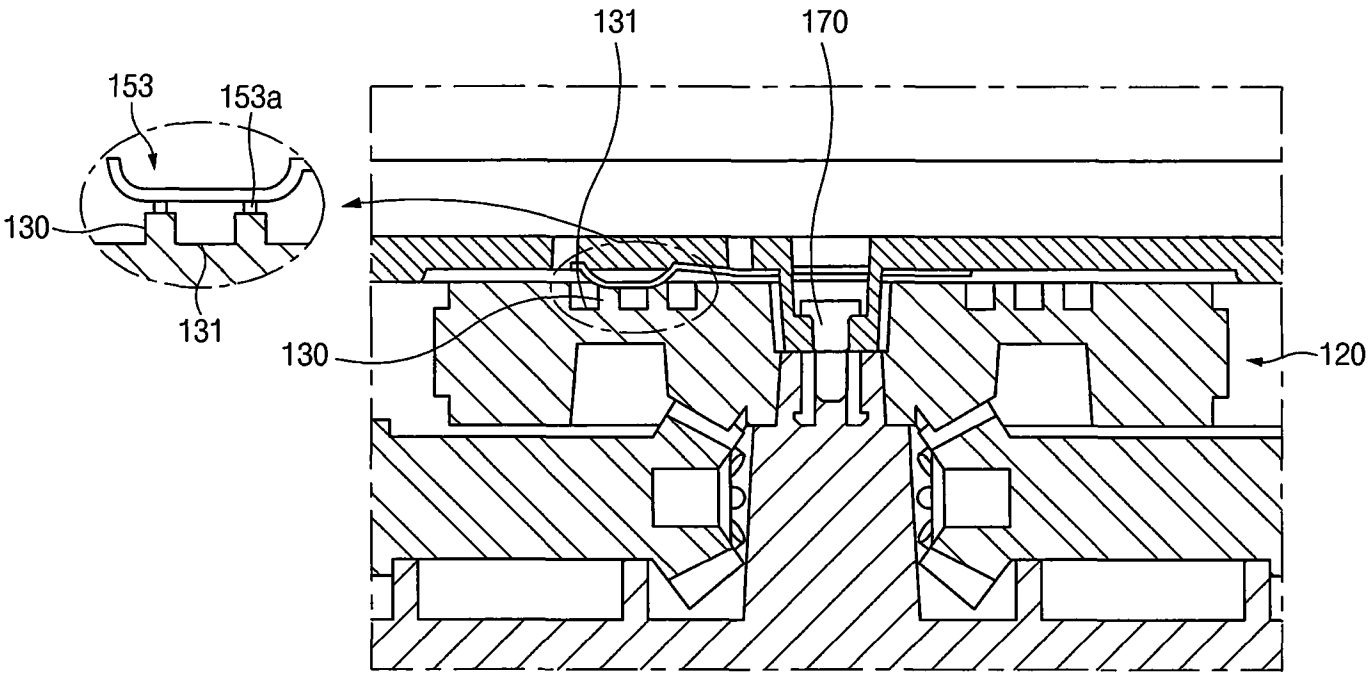
FIG. 16 is a cross-sectional view of a wheel button structure, according to an embodiment of the present disclosure.

FIG. 15 is a plan view of a wheel button structure, according to an embodiment of the present disclosure. FIG. 16 is a cross-sectional view of a wheel button structure, according to an embodiment of the present disclosure.

Referring to FIGS. 15 and 16, a serration part 150 according to yet another embodiment of the present disclosure different from the embodiments described with respect to FIGS. 9-12 and FIGS. 13-14, includes a plurality of third protrusions 136 formed on an upper surface of the barrier wall 130 and a second spring part 153 fixed to the upper case 111, on which the fourth protrusion 153*a* is formed to make contact with the third protrusions 136.

That is, different from the serration parts 150 according to embodiments described with respect to FIGS. 9-12 and FIGS. 13-14, which include the serration plate 151, the serration part 150 according to FIGS. 15 include the third protrusions 136 protruded upward from the upper surface of the barrier wall 130.

Referring to FIG. 15, the third protrusions 136 is arranged along the upper surface of the barrier wall 130 and spaced apart from each other, and a recess 136*a* recessed in one direction may be formed between the third protrusions 136.

The second spring part 153 is fixed to the upper case 111 and includes the fourth protrusion 153*a* fixed to the upper case 111 and making contact with the third protrusions 136.

Referring to FIGS. 15 and 16, in the case where the barrier wall 130 has a substantially spiral shape with respect to the rotation axis 170 as an example, the fourth protrusion 153*a* is provided in a plural number to substantially simultaneously make contact with the third protrusion 136 formed on the upper surface of the barrier wall 130 adjacent to each other, and the fourth protrusions 153*a* is spaced apart from each other by a distance corresponding to a distance between the barrier walls 130.

Therefore, in the case where the wheel part 120 rotates, the barrier wall 130 disposed on the upper surface 121 of the wheel part 120 rotates, and since the barrier wall 130 rotates, the third protrusions 136 rotates with respect to the rotation axis 170. The second spring part 153 is maintained in a state in which the second spring part 153 is fixed to the upper case 111, and the fourth protrusion 153*a* disposed on the second spring part 153 is maintained at a fixed state.

As a result, in the case where the wheel part 120 rotates, the third protrusion 136 rotates and the fourth protrusion 153*a* sequentially makes contact with the third protrusion 136*a*, the recess 136*a*, the third protrusion 136, and the recess 136*a*. Thus, the fourth protrusion 153*a* makes contact with the uneven surface formed on the upper surface of the barrier walls 130, so that the user may recognize whether the wheel part 120 rotates. In this case, the second spring part 153 senses the rotation of the wheel part 120 since the fourth protrusion 153*a* makes contact with the third protrusions 136 while pressurizing the third protrusions 136 and sequentially makes contact with the third protrusions 136 and the recess 136*a* during the rotation of the wheel part 120.

Referring to FIG. 1, the electronic device according to the conventional art includes the transfer device 160 configured to include a first gear part (not shown) coupled to the wheel part 120 and a second gear part connected to the first gear part (not shown) and rotated in association with the first gear part (not shown).

The first gear part is formed on the lower surface of the wheel part, and the first gear part and the second gear part may be a planetary gear having two axes substantially perpendicular to each other.

The wheel button structure 100 may previously set the rotation range of the wheel part 120 using the number of the wraps of the barrier wall 130 with respect to the rotation axis 170 and includes the function of the stopper 140 to restrict the rotation of the wheel part 120 when the wheel part 120 rotates over the set range.

In addition, independently from that of the wheel button structure 100 having the function of the stopper 140, the wheel button structure 100 includes the serration part 150 described in FIGS. 9-16 to allow the user to recognize the rotation of the wheel part 120.

Since the wheel button structure 100 includes the serration part 150, the user may rotate the wheel part while recognizing the rotation of the wheel part 120.

While the present disclosure has been shown and described with reference to certain embodiments thereof, it will be understood by those skilled in the art that various changes in form and details may be made therein without departing from the spirit and scope of the present disclosure. Therefore, the scope of the present disclosure is defined not by the detailed description of the present disclosure, but by the appended claims and their equivalents.

What is claimed is:

1. A wheel button structure comprising:

a case part comprising an upper case through which a guide hole is formed;

a wheel part rotating in the case part with respect to a rotation axis fixed to one side of the case part, and comprising a barrier wall formed on a surface facing the guide hole to wrap a plurality of times around the rotation axis; and a stopper comprising a lower portion inserted between a first part of the barrier wall and a second part of the barrier wall adjacent to the first part of the barrier wall and an upper portion inserted into the guide hole, wherein the stopper comprises a recess recessed inward to a lower end between the first part and the second part of the barrier wall, and the barrier wall comprises a protrusion formed a first end disposed adjacent to the rotation access and a second end disposed at a position more spaced apart from the rotation axis than the first end and inserted into the recess, and wherein the stopper moves along the guide hole when the wheel part rotates.

2. The wheel button structure of claim 1, wherein the barrier wall is disposed on an upper surface of the wheel part to have a substantially spiral shape.

3. The wheel button structure of claim 2, wherein the stopper comprises the upper portion moving along the guide hole during the rotation of the wheel part and the lower portion moving from the first end of the barrier wall to the second end of the barrier wall, and the movement of the upper portion and the lower portion is restricted at both ends of the barrier wall.

4. The wheel button structure of claim 1, wherein the guide hole is formed in a diameter direction of the wheel part penetrating through the rotation axis.

5. The wheel button structure of claim 4, wherein the stopper comprises:

a first body inserted between the barrier walls;

a second body inserted into the guide hole; and a first separation preventing plate disposed between the first body and the second body, comprising a lower surface making contact with an upper surface of the barrier wall, and having a width greater than a width of the guide hole.

6. The wheel button structure of claim 1, further comprising a serration part to sense a rotation of the wheel part when a user rotates the wheel part.

7. The wheel button structure of claim 6, wherein the serration part comprises:

a serration plate comprising a plurality of first protrusions disposed on a lower surface of the serration plate; and a first spring part comprising a second protrusion protruded toward the plurality of protrusions and sequentially making contact with the plurality of first protrusions when the wheel part rotates.

8. The wheel button structure of claim 7, wherein each of the plurality of first protrusions has a portion of a polygonal shape or a curved surface in a cross-section and a recess is formed between protrusions of the plurality of first protrusions adjacent to each other.

9. The wheel button structure of claim 7, wherein the serration plate is fixed to the upper case, the first spring part is fixed to the wheel part, and the second protrusion rotates to sequentially make contact with the plurality of first protrusions when the wheel part rotates.

10. The wheel button structure of claim 7, wherein the first spring part is fixed to one side of the case part, the serration plate is fixed to the wheel part, and the plurality of first protrusions rotate to allow the second protrusion to sequentially make contact with the plurality of first protrusions when the wheel part rotates.

11. The wheel button structure of claim 10, wherein the first spring part is fixed to the one side of the case part under the wheel part and the serration plate is fixed to a lower surface of the wheel part.

12. The wheel button structure of claim 11, wherein the serration plate is integrally formed with the wheel part as a single body.

13. The wheel button structure of claim 6, wherein the serration part comprises:

a plurality of third protrusions disposed on an upper surface of the barrier wall; and a second spring part fixed to the upper case and comprising a one or more fourth protrusions making contact with the plurality of third protrusions.

14. The wheel button structure of claim 13, wherein the one or more fourth protrusion is provided comprises a plurality of fourth protrusions, and the plurality of fourth protrusions are disposed spaced apart from each other by a distance between the barrier wall, wherein the plurality of fourth protrusions substantially simultaneously make contact with the plurality of third protrusions disposed on the barrier wall adjacent to each other.

15. The wheel button structure of claim 6, further comprising a transfer device which operates while interlocked with the wheel part, wherein the transfer device comprises:

a first gear part disposed on a lower surface of the wheel part; and a second gear part connected to the first gear part and rotating interlocked with the first gear part.

* * * * *